US005986571A

United States Patent [19]

Flick

[11] Patent Number: 5,986,571

[45] Date of Patent: Nov. 16, 1999

[54] BUILDING SECURITY SYSTEM HAVING REMOTE TRANSMITTER CODE VERIFICATION AND CODE RESET FEATURES

[76] Inventor: Kenneth E. Flick, 5236 Presley Pl., Douglasville, Ga. 30135

[21] Appl. No.: 09/034,696

[22] Filed: Mar. 4, 1998

[51] Int. Cl.[6] ..... G08C 19/00

[52] U.S. Cl. ..... 340/825.72; 341/174; 341/175; 341/176; 340/539; 307/10.1

[58] Field of Search ..... 340/825.22, 825.72, 340/825.69, 539, 825.3, 825.36, 825.37; 307/101, 10.2; 341/174, 176, 175

[56] References Cited

U.S. PATENT DOCUMENTS

| | | | |
|---|---|---|---|
| 4,881,148 | 11/1989 | Lambropoulos et al. . | |
| 4,928,098 | 5/1990 | Dannhaeuser . | |
| 4,975,969 | 12/1990 | Tal . | |
| 5,049,867 | 9/1991 | Stouffer . | |
| 5,055,701 | 10/1991 | Takeuchi . | |
| 5,099,226 | 3/1992 | Andrews . | |
| 5,103,221 | 4/1992 | Memmola . | |
| 5,146,215 | 9/1992 | Drori . | |
| 5,243,322 | 9/1993 | Thompson et al. . | |
| 5,252,966 | 10/1993 | Lambropoulos et al. . | |
| 5,278,547 | 1/1994 | Suman et al. . | |
| 5,365,225 | 11/1994 | Bachhuber . | |
| 5,406,274 | 4/1995 | Lambropoulos et al. . | |
| 5,412,379 | 5/1995 | Waraksa et al. . | |
| 5,442,341 | 8/1995 | Lambropoulos . | |
| 5,469,506 | 11/1995 | Berson et al. . | |
| 5,513,105 | 4/1996 | Krones . | |
| 5,563,579 | 10/1996 | Carter . | |
| 5,654,688 | 8/1997 | Allen et al. . | |
| 5,682,133 | 10/1997 | Johnson et al. | 340/426 |

FOREIGN PATENT DOCUMENTS

| | | | |
|---|---|---|---|
| 0 535 555 A1 | 9/1992 | European Pat. Off. | E05B 49/00 |
| 43 25 221 A1 | 7/1993 | Germany | B60R 25/00 |
| 91/15645 | 10/1991 | WIPO | E05B 49/00 |

OTHER PUBLICATIONS

8–in–1 Universal Remote Control Cat. No. 15–1903A; whole document, 1990.

*Primary Examiner*—Michael Horabik
*Assistant Examiner*—Anthony A. Asongwed
*Attorney, Agent, or Firm*—Allen, Dyer, Doppelt, Milbrath & Gilchrist, P. A.

[57] ABSTRACT

A building security system includes an alarm controller for learning a unique remote transmitter code to define a learned transmitter capable of switching the controller between armed and disarmed states. The controller performs learned code verification to generate an indication relating to whether a new remote transmitter has been learned by the controller. In one embodiment, the learned code verification is based upon the alarm controller being recently entered into the learning mode. According to another embodiment, the learned code verification is based upon a number of learned remote transmitters, a change in that number, or a change in the identity of a learned code. The indication may be provided at the building or remote therefrom by any of a light, a visual display, a speech message generator, and an audible signal generator, for example. A previous set of authorized or learned remote transmitter codes may be readily reset or restored to operate the system if unauthorized codes have been more recently added.

55 Claims, 5 Drawing Sheets

BUILDING SECURITY SYSTEM HAVING REMOTE TRANSMITTER CODE VERIFICATION AND CODE RESET FEATURES

FIELD OF THE INVENTION

The present invention relates to the field of control systems, and more particularly, to a building security system.

BACKGROUND OF THE INVENTION

Commercial and residential building security systems are widely used to deter theft of valuables, and to create a greater sense of security for the building occupants. A conventional building security system may include a central alarm controller and a plurality of building sensors connected to the controller. The building sensors may include switches on exterior doors and windows, as well as motion sensors or detectors inside and outside the building. An alarm siren, security lights, etc. may be activated responsive to the alarm controller detecting an intrusion based upon a triggered sensor and when the alarm controller is in the armed mode.

A building security system typically requires a way to move the alarm controller to a disarmed mode so that people can freely enter and exit the building without triggering an alarm. More complicated commercial systems may have computers located in security control centers that monitor access points. Such complicated systems may also include a plurality of magnetic card readers, for example, that grant a card bearer access if the code on the card matches a previously learned code of the system.

Many newer residential security systems include a more basic controller and building sensors. In addition, such residential systems may also include one or more remote transmitters, similar to the ubiquitous garage door opener, for switching the controller from the armed to disarmed state as the user approaches his residence.

Unfortunately, little attention has been paid to the details of the security that may be compromised by such remote transmitters. More particularly, a conventional home security transmitter typically generates a unique code; however, a would-be thief may cause the alarm controller to enter a learning mode and learn a new remote transmitter without the owner's knowledge. Accordingly, the thief can then return when the owner is absent and disarm the security system.

SUMMARY OF THE INVENTION

In view of the foregoing background, it is therefore an object of the present invention to provide a building security system with enhanced features to protect against unauthorized learning of remote transmitter codes which are capable of disarming the alarm controller.

This and other objects, features and advantages in accordance with the present invention are provided by a building security system comprising an alarm controller switchable between an armed mode, being capable of generating an alarm responsive to at least one building security sensor, and a disarmed mode. The system also includes a receiver for receiving a unique identifying code from the remote transmitter. Moreover, the alarm controller may further comprise remote transmitter learning means cooperating with the receiver for learning a unique code of a remote transmitter to define a learned remote transmitter capable of switching the alarm controller. The controller may also include remote transmitter verifying means for generating an indication relating to whether a new uniquely coded remote transmitter has been learned by the remote transmitter learning means. Accordingly, the user is provided with an indication of a potentially unauthorized learned remote transmitter capable of switching the alarm controller.

The remote transmitter learning means is preferably switchable between a learning mode capable of learning a new transmitter, and a normal mode. In one embodiment, the remote transmitter learning means comprises transmitter deleting means for deleting all prior learned remote transmitters based upon entering the learning mode.

The remote transmitter verifying means may comprise learning mode entered indicating means for indicating that the learning mode of the remote transmitter learning means has been entered. The learning mode entered indicating means may include time lapse means for indicating when the learning mode of the code learning means has last been entered. The time lapse means, in turn, may include means for progressively indicating a passage of time since the learning mode has last been entered.

The remote transmitter verifying means may include remote transmitter number indicating means for indicating a number of learned remote transmitters. The remote transmitter verifying means may also indicate a change in a number of learned transmitters, or a change in the identity of a code. For example, the learned code change indicating means may comprise at least one of a light, a visual display, a speech message generator, and an audible signal generator. The remote transmitter verifying means may further include activating means for causing generation of the indication, such as responsive to a building sensor or user input.

The alarm controller may also advantageously include transmitter code reset means for permitting the user to restore at least one previously learned remote transmitter and remove at least one more recently learned remote transmitter. The remote transmitter verifying means may enter a warning mode and remain in the warning mode for a predetermined warning time responsive to a new remote transmitter being learned. In addition, the remote transmitters designated as current are capable switching the alarm controller and wherein remote transmitters designated hold are capable of being changed to current. Accordingly, the transmitter code reset means comprises means for changing at least one remote transmitter from current to hold responsive to learning a new remote transmitter.

The transmitter code reset means may also include means for learning at least one new remote transmitter as a temporary transmitter which is also capable of switching the alarm controller. The transmitter code reset means may delete hold remote transmitters, and convert temporary remote transmitters to current responsive to expiration of the predetermined warning time.

The transmitter code reset means may include means for deleting temporary remote transmitters and maintaining hold transmitters responsive to learning a new remote transmitter when in the warning mode. The transmitter code reset means preferably further includes restore means for restoring hold remote transmitters to current status, and for deleting temporary remote transmitters responsive to learning a new remote transmitter matching a hold transmitter and when in the warning mode. The restore means may further cause exiting of the warning mode.

A method aspect of the invention is for controlling a building security system based upon a uniquely coded remote transmitter. The method preferably comprises the steps of: learning into an alarm controller at least one uniquely coded remote transmitter to define a learned remote transmitter capable of switching the alarm controller between armed and disarmed modes, and generating an indication relating to whether a new remote transmitter has been learned into the alarm controller to thereby alert the user of a potentially unauthorized remote transmitter capable of switching the alarm controller.

DETAILED DESCRIPTION OF THE PREFERRED EMBODIMENTS

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

Figure 1:
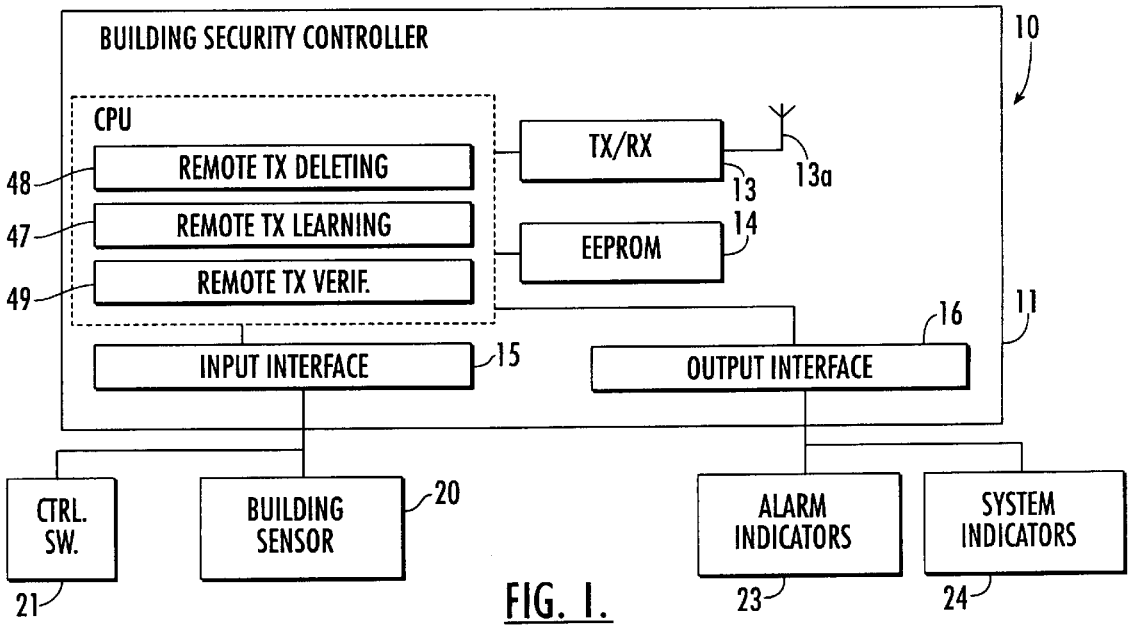
FIG. 1 is a schematic block diagram of the building security system according to the invention.

Referring now to the schematic block diagram of FIG. 1, a building security system 10 according to one aspect of the invention is first described. The security system includes a controller 11 which, in turn, in the illustrated embodiment, includes a central processing unit or microprocessor 12 operating under stored program control.

In the illustrated embodiment, a transmitter and receiver 13 are connected to the microprocessor 12 for receiving signals from a remote transmitter and for transmitting signals to a remote unit, as will be described in greater detail below. As would be readily understood by those skilled in the art, the transmitter portion of the controller 11 may not be needed in some embodiments of the invention. An antenna 13*a* is illustratively connected to the transmitter and receiver 13.

In the illustrated embodiment, the microprocessor is also operatively connected to a memory (EEPROM) 14 and an input interface 15 and an output interface 16. As would be readily understood by those skilled in the art, the microprocessor 12 may alternately or additionally have its own on-board memory.

The input interface 15 is connected to the schematically illustrated building sensors 20 and one or more control switches 21. The building sensors 20 may of a conventional switch or proximity sensor type as will be appreciated by those skilled in the art without further discussion herein.

The output interface 16 of the controller 11 may preferably be connected to a plurality of output devices, such as the schematically illustrated alarm indicators 23 and system indicators 24. The outputs may include auxiliary relay outputs, such as for other control applications as will be readily understood by those skilled in the art. For example, a relay output may be used to switch on security lighting. The alarm indicators 23 may include a local siren, or may include a telephone dialing circuit to contact a remote monitoring station. The local system indicators 24 may include any of a number of indicators, such as lights, audible tone generators, etc.

Figure 2:
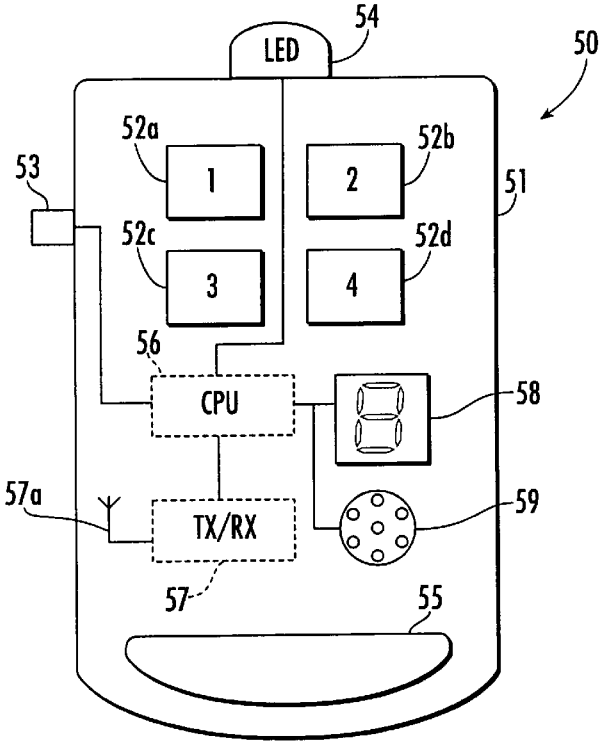
FIG. 2 is a schematic diagram of a remote transmitter for the building security system according to the invention.

Referring now more particularly to FIG. 2, a remote transmitter 50 in accordance with the invention is described. The remote transmitter 50 includes a housing 51 and a plurality of first momentary contact switches 52*a*–52*d* carried by the housing. A second momentary contact switch 53 and an indicating light, such as the illustrated LED 54 are also carried by or mounted on the housing 51. As would be readily understood by those skilled in the art, the remote transmitter 50 is typically relatively small and includes an opening 55 for facilitating connection to a vehicle key ring, for example. In addition, the remote transmitter 50 includes a central processing unit or microprocessor 56 operatively connected to the plurality of first switches 52*a*–52*d*, the second switch 53, and the LED 54.

The microprocessor 56 is also connected to a transmitter and/or receiver circuit 57 and its associated antenna 57*a* for transmitting and/or receiving signals to and from the controller 11 of the building security system 10. Accordingly, the term "remote transmitter" is used broadly herein to describe the embodiment also including receiver means.

The remote transmitter 50 may also include a numeric or alphanumeric display 58, and a speaker 59 coupled to an audible tone generator or a speech message generator, as may be provided by the microprocessor 56. A vibration transducer, not shown, may also be incorporated into the remote transmitter 50 for communicating to the user as would be readily understood by those skilled in the art.

The controller 11 preferably includes remote transmitter learning means 47 for permitting the addition or learning of a coded remote transmitter 50 to be capable of switching the controller between armed and disarmed modes, for example. In the armed mode the controller 11 is capable of generating an alarm via alarm indicators 23, such as the siren and/or flashing lights. The controller 11 generates the alarm responsive to at least one of the building sensors 20 as would be readily understood by those skilled in the art. In the disarmed mode the controller 11 does not generate an alarm responsive to the sensors so that the user may enter the building, for example.

The controller 11 preferably comprises remote transmitter verifying means 49 for generating an indication relating to whether a new uniquely coded remote transmitter has been learned by the remote transmitter learning means 47. In addition, the remote transmitter learning means 47 is preferably switchable between a learning or program mode permitting learning of a unique code of a remote transmitter 50, and a secure mode. As would be readily understood by those skilled in the art, the learning mode may be entered for a relatively short predetermined time and then automatically revert back to the secure mode to reduce the possibility of unauthorized remote transmitters being learned.

In one embodiment, the remote transmitter verifying means 49 comprises learning mode entered indicating means for indicating that the learning mode of the remote transmitter learning means has been entered. More particularly, the learning mode entered indicating means preferably comprises time lapse means for indicating when the learning mode of the remote transmitter learning means has last been entered. This indication can be provided by progressively indicating the elapsed time since the learning mode has last been entered.

According to another approach or embodiment of the invention, the remote transmitter verifying means 49 preferably comprises learned remote transmitter number indicating means for indicating a number of learned remote transmitters. In an embodiment where all remote transmitters are deleted when a new one is learned, the number of learned transmitters may change indicating that an unauthorized transmitter has been learned. Alternately, the remote transmitter verifying means 49 may comprise learned remote transmitter change indicating means for directly indicating a change in a number of learned remote transmitters. In yet another embodiment, the remote transmitter verifying means 49 preferably comprises learned remote transmitter code change indicating means for indicating a change in a unique code of the learned remote transmitters.

The remote transmitter verifying means 49 preferably includes remote transmitter indicating means for providing the indication. In other words, indicating means, such as the local system indicators 24 in the form of an LED may be flashed a number of times corresponding to the number of coded remote transmitters in one embodiment. Accordingly, the user is ensured that only the coded remote transmitters 50 under his control may operate the building security system 10, and that no other remote transmitters have been surreptitiously coded to operate the controller. Other embodiments of remote transmitter indicating means, for example, may include an audible tone generator, numeric display, speech message generator, etc. driven by the controller and associated with the building.

The remote transmitter indicating means may also be associated with or carried by a remote transmitter 50, or may be otherwise remote from the building and be communicated to the remote site via a satellite or cellular telephone connection. For example, the indication means may be provided by a light 54, an alphanumeric display 58, and a speech or tone generator 59, for example, carried by the remote transmitter 50 (FIG. 2). Alternately, a remote monitoring station may be provided to monitor one or a plurality of buildings in cooperation with the transmitter verifying means of each respective building. In addition, a pager may be carried by the user to provide the indication.

The indication given to the user may preferably be the number of coded remote transmitters currently capable of switching the controller 11 to the disarmed mode from the armed mode. Alternately, the indication may be related to a change in the number of coded remote transmitters or a change in a code of a learned remote transmitter. The various indicating means and remote transmitter verifying means may also be used to simply alert the user that the learning mode has been recently entered. Accordingly, the remote transmitter verifying means 49 provides an indication relating to whether one or more remote transmitters has been added or learned without the owner's consent or knowledge. The indicating means may also further comprise repeater means for repeating an indication relating to the number of coded transmitters 50 for a predetermined time period or a predetermined number of repetitions.

Should the user determine that an unauthorized remote transmitter has been added or learned to operate the controller 11, the controller in one embodiment also preferably includes remote transmitter deleting means 48 for permitting deletion of the newly added unauthorized remote transmitter or all of the coded remote transmitters 50 capable of switching the controller between the armed and disarmed modes. In one embodiment, the deleting means preferably comprises means for deleting all of the previously learned remote transmitters. All of the previously learned remote transmitters may be deleted based upon entering the learning mode, that is, either when the learning mode is initially entered or when the first remote transmitter is learned, for example. If all of the coded remote transmitters are deleted by the deleting means 48, the authorized transmitters may thereafter be added by the remote transmitter learning means 47 as would be readily understood by those skilled in the art. As described in greater detail below, in another embodiment, transmitter code reset means may be provided to remove a newly learned code and restore a previously learned code.

The building security system 10 also preferably includes activating means for activating the remote transmitter indicating means responsive to a predetermined condition. For example, the indicating means may be triggered by the activating means responsive to operation of one of a signal from a building sensor 23, remote transmitter 50, or a manually operable switch 21. Other similar means for activating the indicating means are also contemplated by the invention, and will be readily appreciated by those skilled in the art.

Figure 3:
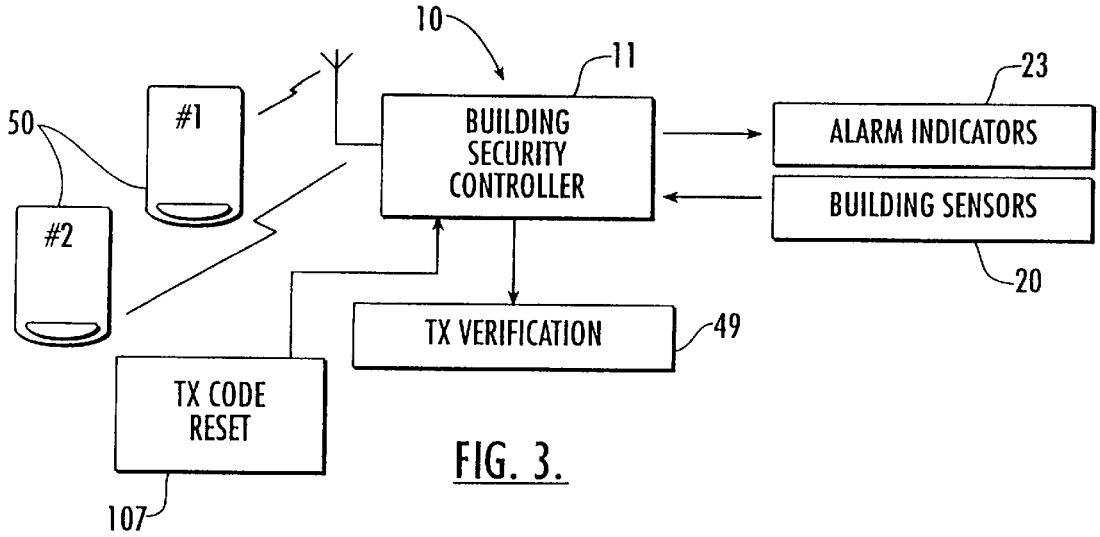
FIG. 3 is a schematic diagram of a remote control building security system according to the present invention.

In brief review, the building security system 10 is schematically illustrated in FIG. 3 and includes the controller 11 along with the alarm indicators 23 and sensors 20. The transmitter verifying means 49 is illustrated in a separate block for clarity, although those of skill in the art will recognize that the logic features of the transmitter verifying means may be readily implemented via the microprocessor of the controller. Two illustrated remote transmitters 50 are capable of switching the controller 11 between armed and disarmed modes. When in the armed mode, tripping of the building sensors 20 may typically activate a siren or other alarm indicator 23. In addition, the building sensors 20 may also be used as part of the activation means to cause the transmitter verifying means to give an indication relating to an unauthorized remote transmitter. Also shown schematically is transmitter code reset means 107 which provides the user with a relatively simple way to reinstate previous learned transmitter codes as will be described in greater detail below.

A method aspect in accordance with the present invention is for increasing security in permitting remote control of a building security controller 11 and using at least one uniquely coded remote transmitter 50, and a receiver 13 for receiving a signal from the uniquely coded remote transmitter. The method preferably comprises the steps of: storing in a memory 14 a unique code of a remote transmitter 50 to define a learned remote transmitter capable of causing the controller two switch between armed and disarmed modes, and generating an indication relating to whether a new uniquely coded remote transmitter has been stored in the memory to thereby alert the user of a potentially unauthorized learned remote transmitter capable of remotely disarming the building security system.

Figure 4:
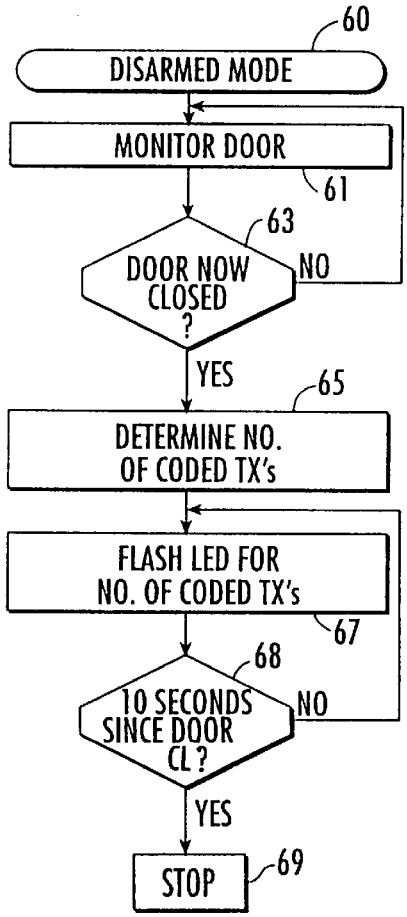
FIGS. 4 and 5 are flow charts illustrating examples of remote transmitter verification according to the invention.

A particular example of the transmitter verification feature of the present invention is explained with further reference to the flow chart of FIG. 4. In this example, the building security system controller 11 (FIGS. 1 and 3) preferably monitors a building sensor 20 (FIG. 1), such as a predetermined door switch, for determining whether the door has been opened or closed as monitored at Block 61 and when the controller is in the disarmed mode (Block 60). If the door is now closed (Block 63), the number of coded remote transmitters 50 is determined or verified (Block 65). The controller 11 also preferably includes activating means for activating a local system indicator 24, for example, to indicate the number of coded transmitters 50 at Block 67. The number of coded transmitters 50 may be repeated for a predetermined time, such as ten seconds, at Block 68. The verification feature is then stopped (Block 69). Those of skill in the art will readily appreciate alternate embodiments incorporating other indicating means or activating means as described in greater detail herein.

Figure 5:
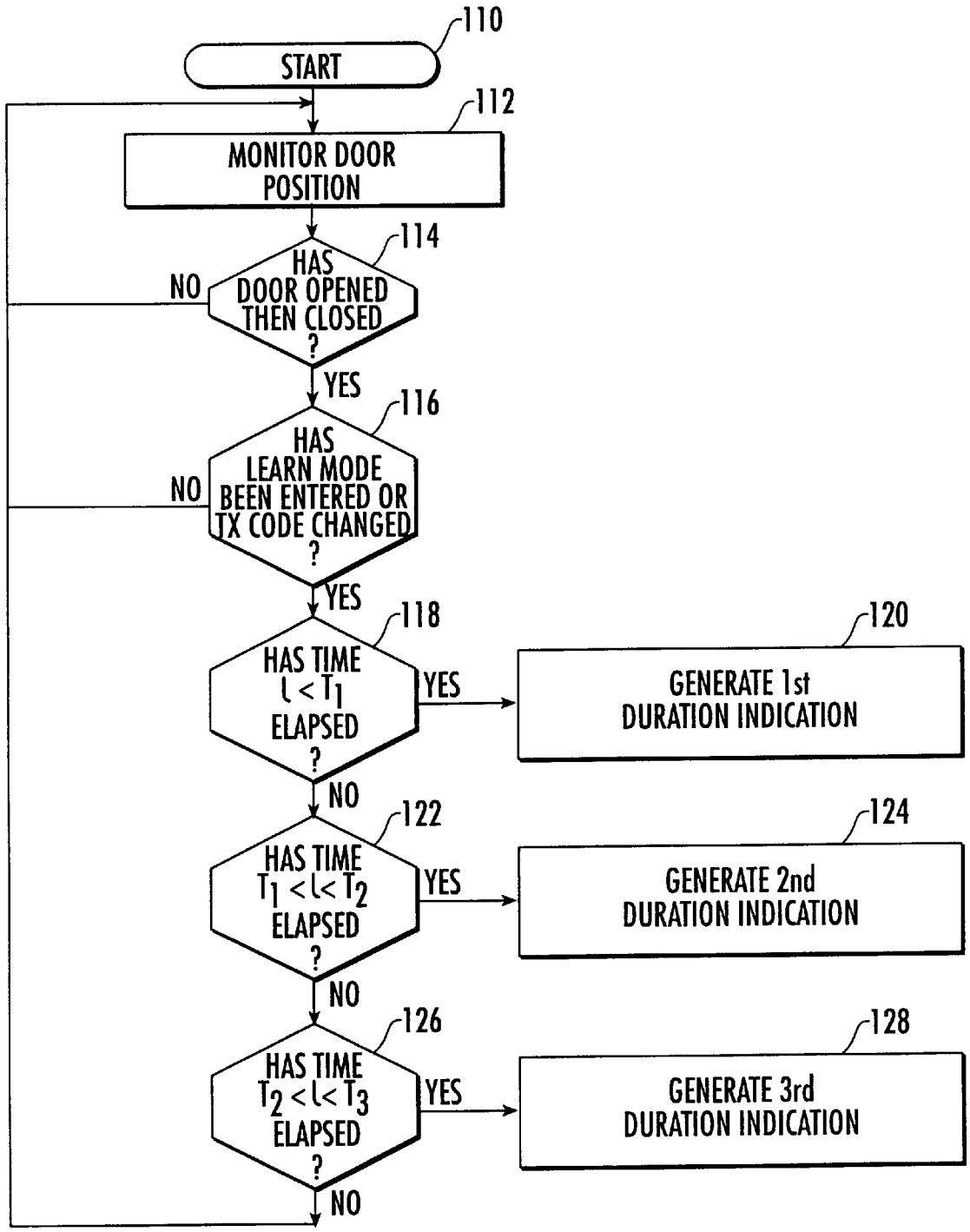

Referring to the flow chart of FIG. 5, another variation of operation of the building security system 10 is now explained. From the start (Block 110), the door position, for example, is monitored at Block 112. If a door has been determined at Block 114 to have been opened and closed, it is next determined whether the remote transmitter learning mode has been entered or a remote transmitter code changed at Block 116. If the door has not been opened and closed, or the learn mode or a transmitter code is not changed, the system returns to monitoring the door position at Block 112.

If the learn mode has been entered or the code changed, the elapsed time t since that event is compared against a threshold T1 at Block 118. If the elapsed time t is less that T1, then a first duration signal may be generated at Block 120. If the elapsed time t is between T1 and a second threshold T2 as determined at Block 122, then a second duration indication can be generated (Block 124). Similarly, if the elapsed time t is between T2 and a third threshold T3 as determined at Block 126, then a third duration indication may be given at Block 128. The sequence can be extended or shortened as would be readily appreciated by those skilled in the art.

For example, if the learn mode has been entered within the prior forty-eight hours, an indicating light may be illuminated for a thirty second duration responsive to the activation means. The duration could thereafter be decremented five seconds for each 48 hours of elapsed time, so that the indication would eventually automatically terminate with the passage of sufficient time. As another example, the light could be illuminated for ninety seconds the first day, and decrement ten seconds each day thereafter. It is desirable that the indication inform the user of how recently the learn mode or transmitter change has been made so that the user may correlate the change with someone's ability to access the system. An appropriate voice message could also be generated alerting the user to when the learning mode was last entered, for example.

Another aspect of the invention relates to the transmitter code reset means which permits the user to restore at least one previously learned code and remove at least one more recently learned code. The remote transmitter verifying means may enter a warning mode and remain in the warning mode for a predetermined warning time responsive to a new uniquely coded remote transmitter being learned. In addition, the learned codes designated as current are capable of switching the alarm controller for the building security system, and the codes designated hold are capable of being changed to current. Accordingly, the transmitter code reset means preferably comprises means for changing at least one code from current to hold responsive to learning a new uniquely coded transmitter.

The transmitter code reset means may further comprise means for learning at least one new uniquely coded transmitter as a temporary code which is also capable of switching the alarm controller. The transmitter code reset means may further include means for deleting hold codes, and converting temporary codes to current codes responsive to expiration of the predetermined warning time. Also, the transmitter code reset means may delete temporary codes and maintain hold codes responsive to learning a new uniquely coded transmitter when in the warning mode.

The transmitter code reset means may also include restore means for restoring hold codes to current codes, and for deleting temporary codes responsive to learning a new uniquely coded remote transmitter matching a hold code and when in the warning mode. The restore means may also further comprise means for exiting the warning mode.

The various means associated with the transmitter code reset feature may be readily implemented using the processor of the controller, for example, or may be implemented using conventional logic and signal processing circuitry as will be readily appreciated by those skilled in the art.

Figure 6:
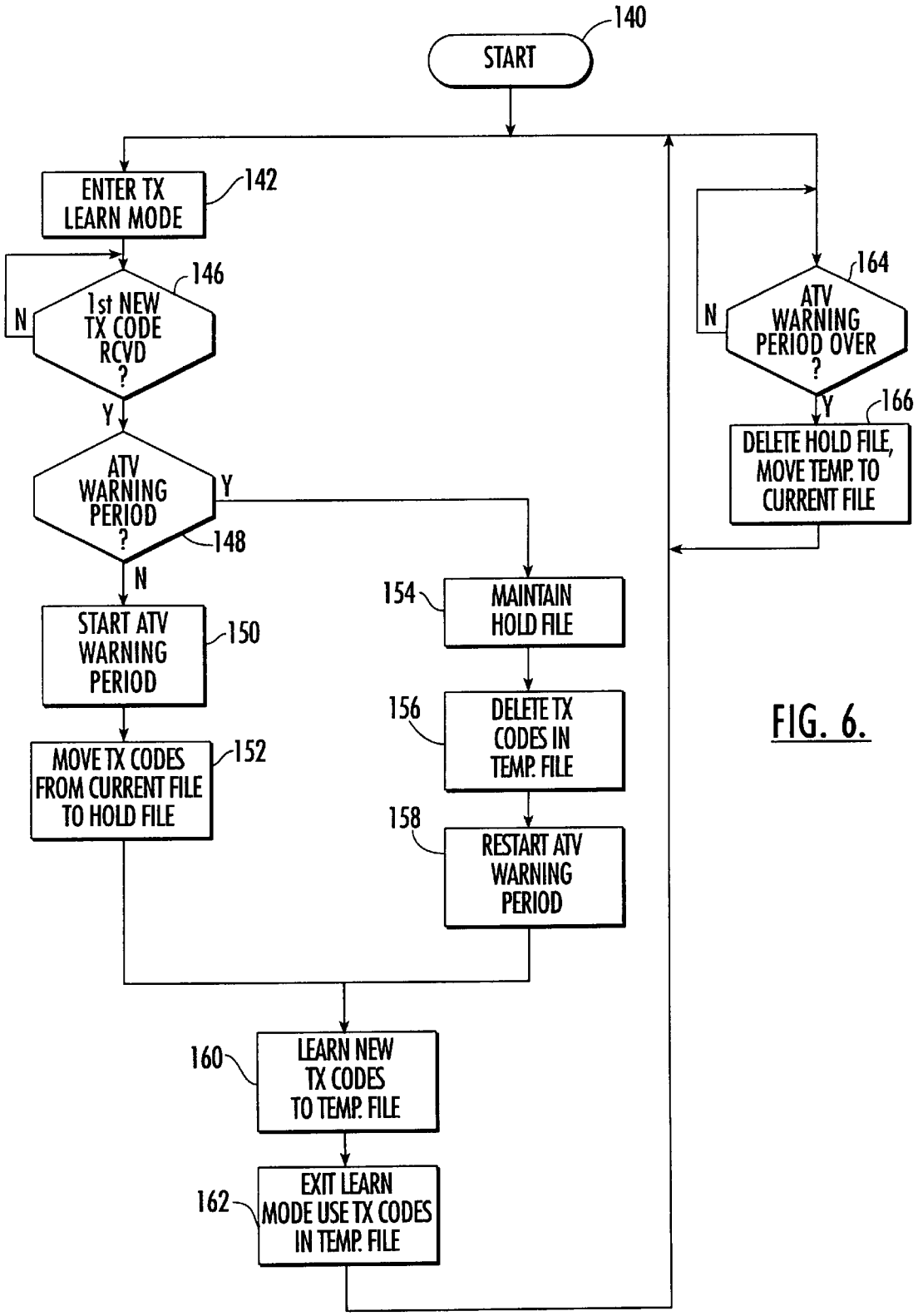
FIG. 6 is a first flow chart illustrating a portion of the transmitter code reset feature in accordance with the present invention.

Turning now additionally to the flow chart of FIG. 6 operation of the transmitter code reset function of the present invention is further described. From the start (Block 140), the user may enter the controller into the transmitter learning mode at Block 146. Entry into the learning mode has been described above, however, those of skill in the art will appreciate that there are many other equivalent techniques to cause the controller to enter the transmitter learning mode.

Once in the learning mode, it is determined at Block 146 whether a new transmitter code has been received. If a code is received, then at Block 148 it is determined whether the 48 hour Automatic Transmitter Verification (ATV) warning period as described above is still in progress. Of course the time could be changed to any suitable value depending on the application. If the controller is not currently in the ATV warning period, then the ATV warning period is started at Block 150, and remote transmitter codes are moved from a current file to a hold file. As would be readily appreciated by those skilled in the art, the codes may not necessarily be transferred to another portion of memory, for example, rather a designation for the code may simply be updated.

At Block 160, the controller learns the newly received transmitter codes to a so-called temporary file. The newly learned transmitter codes remain in the temporary file or keep their temporary designation and are used to operate the controller upon exit from the learning mode (Block 162) as will be readily appreciated by those skilled in the art.

Turning now briefly to the upper right-hand portion of FIG. 6, at Block 164 it is determined whether the ATV warning period has expired. If so, the transmitter codes in the hold file are deleted, and the transmitter codes in the temporary file are moved to the current file. In other words, once the ATV warning period expires, the hold file contents are deleted and the temporary codes become the current codes. The current code operate the controller until the learning mode is again entered.

If during the learning mode, the ATV warning period was already active as determined at Block 148, the hold file contents are maintained (Block 154). In addition, the transmitter codes in the temporary file are deleted at Block 156. Accordingly, this defeats the would-be thief from entering the learning mode several times without the user's knowledge. In other words, the codes in the hold file should be those previously authorized by the user.

At Block 158 the ATV warning period may be restarted. Thereafter, the controller learns the new transmitter codes into the temporary file (Block 160), and the system operates with the new temporary codes upon exit from the learning mode (Block 162).

Figure 7:
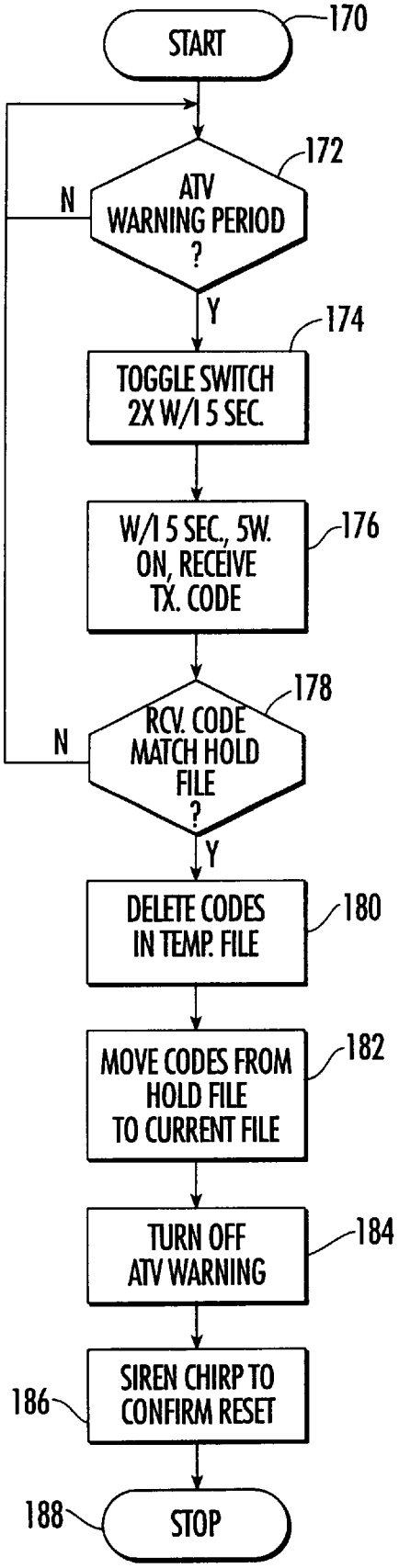
FIG. 7 is a second flow illustrating another portion of the transmitter code reset feature in accordance with the present invention.

Turning now additionally to the flow chart of FIG. 7, a method for returning the proper transmitter codes to operate the system and to delete any unauthorized codes is explained. The user desires both security and convenience. From the start (Block 170), if the system is still in the ATV warning period as determined at Block 172, then the user may toggle a system control switch on and off two times within 5 seconds (Block 174). The user may then transmit a code from a transmitter in his possession, and if the switch is on, and was toggled within the last 5 seconds, then the system will compare the received code with the hold file codes (Block 178).

If the just received code matches a code in the hold file, then the codes in the temporary file are deleted at Block 180. This removes the temporary codes that may have been surreptitiously added by a would-be thief. In addition, the transmitter codes from the hold file are then moved to the current file (Block 182). This restores the user's previous authorized hold codes to operate the system. The ATV warning is turned off at Block 184, and the siren may be chirped at Block 186, before stopping (Block 188), to thereby provide the user with confirmation that the codes from the temporary file have been deleted, and the codes from the hold file have been re-activated or changed to the current designation or file.

Further information relating to a related area of vehicle security systems and aspects thereof may be found in parent patent U.S. Pat. No. 5,654,688, assigned to the assignee of the present invention and incorporated herein by reference in its entirety. In addition, many modifications and other embodiments of the invention will come to the mind of one skilled in the art having the benefit of the teachings presented in the foregoing descriptions and the associated drawings. Therefore, it is to be understood that the invention is not to be limited to the specific embodiments disclosed, and that modifications and embodiments are intended to be included within the scope of the appended claims.

That which is claimed is:

1. A building security system comprising:

at least one building security sensor;

an alarm controller switchable between an armed mode for generating an alarm responsive to the at least one building security sensor, and a disarmed mode;

at least one uniquely coded remote transmitter;

a receiver for receiving a signal from said at least one uniquely coded remote transmitter;

remote transmitter learning means, operatively connected to said receiver, for learning a unique code of a remote transmitter to define a learned remote transmitter for remotely switching the alarm controller;

remote transmitter verifying means for generating an indication relating to whether a new uniquely coded remote transmitter has been learned by the remote transmitter learning means to thereby alert the user of a potentially unauthorized learned remote transmitter for switching the alarm controller.

2. A building security system according to claim 1 further comprising transmitter code reset means for permitting the user to restore at least one previously learned code and remove at least one more recently learned code.

3. A building security system according to claim 2 wherein said remote transmitter verifying means enters a warning mode and remains in the warning mode for a predetermined warning time responsive to a new uniquely coded remote transmitter being learned.

4. A building security system according to claim 3 wherein learned codes designated as current are for switching the alarm controller; wherein codes designated hold are changeable to current; and wherein said transmitter code reset means comprises means for changing at least one code from current to hold responsive to learning a new uniquely coded transmitter.

5. A building security system according to claim 4 wherein said transmitter code reset means further comprises means for learning at least one new uniquely coded transmitter as a temporary code for also switching the alarm controller.

6. A building security system according to claim 5 wherein said transmitter code reset means further comprises means for deleting hold codes, and converting temporary codes to current codes responsive to expiration of the predetermined warning time.

7. A building security system according to claim 6 wherein said transmitter code reset means comprises means for deleting temporary codes and maintaining hold codes responsive to learning a new uniquely coded transmitter when in the warning mode.

8. A building security system according to claim 7 wherein said transmitter code reset means further comprises restore means for restoring hold codes to current codes, and for deleting temporary codes responsive to learning a new uniquely coded remote transmitter matching a hold code and when in the warning mode.

9. A building security system according to claim 8 wherein said restore means further comprises means for exiting the warning mode.

10. A building security system according to claim 1 wherein said remote transmitter verifying means comprises learning mode entered indicating means for indicating that a learning mode of said remote transmitter learning means has been entered.

11. A building security system according to claim 10 wherein said learning mode entered indicating means comprises time lapse means for indicating when the learning mode of said remote transmitter learning means has last been entered.

12. A building security system according to claim 11 wherein said time lapse means comprises means for progressively indicating a passage of time since the learning mode has last been entered.

13. A building security system according to claim 1 wherein said remote transmitter verifying means comprises learned remote transmitter number indicating means for indicating a number of learned remote transmitters.

14. A building security system according to claim 1 wherein said remote transmitter verifying means comprises learned remote transmitter change indicating means for indicating a change in a number of learned remote transmitters.

15. A building security system according to claim 1 wherein said remote transmitter verifying means comprises learned remote transmitter code change indicating means for indicating a change in a unique code of learned remote transmitters.

16. A building security system according to claim 1 wherein said remote transmitter verifying means comprises indicating means for generating an indication relating to whether a new uniquely coded remote transmitter has been learned by the remote transmitter learning means.

17. A building security system according to claim 16 wherein said indicating means comprises building indicating means associated with the building; and wherein said building indicating means comprises at least one of a light, a visual display, a speech message generator, and an audible signal generator.

18. A building security system according to claim 16 wherein said indicating means comprises remote indicating means remotely positioned from the building; and wherein said remote indicating means comprises at least one of a light, a visual display, a speech message generator, and an audible signal generator.

19. A building security system according to claim 16 wherein said remote transmitter verifying means further comprises activating means for causing said indicating means to generate an indication.

20. A building security system according to claim 19 wherein said activating means comprises building activating means associated with the building; and wherein said building activating means comprises at least one of a manually operated switch and a building sensor.

21. A building security system according to claim 19 wherein said activating means comprises remote activating means remote from the building; and wherein said remote activating means comprises a remote transmitter.

22. A building security system comprising:

an alarm controller switchable between an armed mode for generating an alarm responsive to at least one building security sensor, and a disarmed mode;

at least one uniquely coded remote transmitter;

a receiver for receiving a signal from said at least one uniquely coded remote transmitter;

remote transmitter learning means, operatively connected to said receiver, for learning a unique code of a remote transmitter to define a learned remote transmitter for remotely switching the alarm controller;

remote transmitter verifying means for generating an indication relating to whether a new uniquely coded remote transmitter has been learned by the remote transmitter learning means to thereby alert the user of a potentially unauthorized learned remote transmitter for switching the alarm controller; and transmitter code reset means for permitting the user to restore at least one previously learned code and remove at least one more recently learned code.

23. A building security system according to claim 22 wherein said remote transmitter verifying means enters a warning mode and remains in the warning mode for a predetermined warning time responsive to a new uniquely coded remote transmitter being learned.

24. A building security system according to claim 23 wherein learned codes designated as current are for switching the alarm controller; wherein codes designated hold are changeable to current; and wherein said transmitter code reset means comprises means for changing at least one code from current to hold responsive to learning a new uniquely coded transmitter.

25. A building security system according to claim 24 wherein said transmitter code reset means further comprises means for learning at least one new uniquely coded transmitter as a temporary code for also switching the alarm controller.

26. A building security system according to claim 25 wherein said transmitter code reset means further comprises means for deleting hold codes, and converting temporary codes to current codes responsive to expiration of the predetermined warning time.

27. A building security system according to claim 26 wherein said transmitter code reset means comprises means for deleting temporary codes and maintaining hold codes responsive to learning a new uniquely coded transmitter when in the warning mode.

28. A building security system according to claim 27 wherein said transmitter code reset means further comprises restore means for restoring hold codes to current codes, and for deleting temporary codes responsive to learning a new uniquely coded remote transmitter matching a hold code and when in the warning mode.

29. A building security system according to claim 28 wherein said restore means further comprises means for exiting the warning mode.

30. A building security system according to claim 22 wherein said remote transmitter verifying means comprises learning mode entered indicating means for indicating that a learning mode of said remote transmitter learning means has been entered.

31. A building security system according to claim 30 wherein said learning mode entered indicating means comprises time lapse means for indicating when the learning mode of said remote transmitter learning means has last been entered.

32. A building security system according to claim 31 wherein said time lapse means comprises means for progressively indicating a passage of time since the learning mode has last been entered.

33. A building security system according to claim 22 wherein said remote transmitter verifying means comprises learned remote transmitter number indicating means for indicating a number of learned remote transmitters.

34. A building security system according to claim 22 wherein said remote transmitter verifying means comprises learned remote transmitter change indicating means for indicating a change in a number of learned remote transmitters.

35. A building security system according to claim 22 wherein said remote transmitter verifying means comprises learned remote transmitter code change indicating means for indicating a change in a unique code of learned remote transmitters.

36. A building security system according to claim 22 wherein said remote transmitter verifying means comprises indicating means for generating an indication relating to whether a new uniquely coded remote transmitter has been learned by the remote transmitter learning means.

37. A building security system according to claim 36 wherein said indicating means comprises building indicating means associated with the building; and wherein said building indicating means comprises at least one of a light, a visual display, a speech message generator, and an audible signal generator.

38. A building security system according to claim 36 wherein said indicating means comprises remote indicating means remotely positioned from the building; and wherein said remote indicating means comprises at least one of a light, a visual display, a speech message generator, and an audible signal generator.

39. A building security system according to claim 36 wherein said remote transmitter verifying means further comprises activating means for causing said indicating means to generate an indication.

40. A building security system according to claim 39 wherein said activating means comprises building activating means associated with the building; and wherein said building activating means comprises at least one of a manually operated and a building sensor.

41. A building security system according to claim 39 wherein said activating means comprises remote activating means remote from the building; and wherein said remote activating means comprises a remote transmitter.

42. A method for increasing security in a building security system using at least one uniquely coded remote transmitter and an alarm controller at the building for receiving a signal from the at least one uniquely coded remote transmitter and switching between armed and disarmed states, said method comprising the steps of:

storing in a memory a unique code of a remote transmitter to define a learned remote transmitter for causing switching of the alarm controller; and generating an indication relating to whether a new uniquely coded remote transmitter has been stored in the memory to thereby alert the user of a potentially unauthorized learned remote transmitter for remotely switching the alarm controller.

43. A method according to claim 42 further comprising the step of restoring at least one previously learned code and removing at least one more recently learned code.

44. A method according to claim 43 wherein the restoring and removing step comprises entering a warning mode and remaining in the warning mode for a predetermined warning time responsive to a new uniquely coded remote transmitter being learned.

45. A method according to claim 44 wherein learned codes designated as current are for causing switching of the alarm controller; wherein codes designated hold are changeable to current; and wherein the step of restoring and removing comprises changing at least one code from current to hold responsive to learning a new uniquely coded transmitter.

46. A method according to claim 45 wherein the step of restoring and removing comprises learning at least one new uniquely coded transmitter as a temporary code for also causing switching of the alarm controller.

47. A method according to claim 46 wherein the step of restoring and removing comprises deleting hold codes, and converting temporary codes to current codes responsive to expiration of the predetermined warning time.

48. A method according to claim 47 wherein the step of restoring and removing comprises deleting temporary codes and maintaining hold codes responsive to learning a new uniquely coded transmitter when in the warning mode.

49. A method according to claim 48 wherein the step of restoring and removing comprises restoring hold codes to current codes, and for deleting temporary codes responsive to learning a new uniquely coded remote transmitter matching a hold code and when in the warning mode.

50. A method according to claim 49 wherein the step of restoring and removing further comprises exiting the warning mode.

51. A method according to claim 42 wherein the step of generating an indication comprises indicating that the learning mode of the memory has been entered.

52. A method according to claim 50 wherein the step of indicating comprises indicating when the learning mode of the memory has last been entered.

53. A method according to claim 51 wherein the step of indicating comprises progressively indicating a passage of time since the learning mode has last been entered.

54. A method according to claim 50 wherein the step of generating an indication comprises indicating a number of learned remote transmitters.

55. A method according to claim 50 wherein the step of generating an indication comprises indicating a change in a number of learned remote transmitters.

* * * * *

UNITED STATES PATENT AND TRADEMARK OFFICE

CERTIFICATE OF CORRECTION

PATENT NO. : 5,986,571
DATED : November 16, 1999
INVENTOR(S) : Kenneth E. Flick

It is certified that error appears in the above-identified patent and that said Letters Patent is hereby corrected as shown below:

On the title page,

| | |
|---|---|
| Related U.S. Application Data {63} | Please Insert: - -Continuation-in-part of U.S. Patent Application Serial No. 08/622,515 filed March 25, 1996, which, in turn, is a continuation-in-part of U.S. Patent No. 5,654,688.- - |
| Column 1, Between Title and "Field of the Invention" | Between Title and FIELD OF THE INVENTION, Please Insert: - -**Related Application** The present application is a continuation-in-part application of U.S. patent application serial no. 08/622,515 filed March 25, 1996, which, in turn, is a continuation-in-part of U.S. Patent No. 5,654,688.- - |

Signed and Sealed this

Thirteenth Day of February, 2001

*Attest:*

*Attesting Officer*

Nicholas P. Godici

NICHOLAS P. GODICI

*Acting Director of the United States Patent and Trademark Office*